United States Patent [19]

Dinan et al.

[11] 4,262,439

[45] Apr. 21, 1981

[54] DISPLAY STAND

[75] Inventors: James M. Dinan, Irvington, N.Y.; Frank De Nigris, Parsippany, N.J.

[73] Assignee: Dinaco, Inc., Irvington, N.Y.

[21] Appl. No.: 40,650

[22] Filed: May 21, 1979

[51] Int. Cl.[3] ..... G09F 7/20

[52] U.S. Cl. ..... 40/607; 211/128; 211/187

[58] Field of Search ..... 40/607, 606, 605, 155; 248/122; 211/128, 187, 186, 144, 153, 133

[56] References Cited

U.S. PATENT DOCUMENTS

| | | | |
|---|---|---|---|
| 1,915,727 | 6/1933 | Friedemann . | |
| 2,155,097 | 4/1939 | Mendle | 248/125 |
| 2,290,410 | 7/1942 | Dawson | 155/82 |
| 2,689,050 | 9/1954 | Albin | 40/606 X |
| 2,765,136 | 10/1956 | Knapp | 248/49 |
| 3,119,588 | 1/1964 | Keats | 40/606 X |
| 3,194,403 | 7/1965 | Van Horn | 248/122 X |
| 3,245,365 | 4/1966 | Doherty | 108/144 |
| 3,458,234 | 7/1969 | Bates | 297/437 |
| 3,963,126 | 6/1976 | Taub | 40/607 X |

FOREIGN PATENT DOCUMENTS

| | | | |
|---|---|---|---|
| 611678 | 1/1961 | Canada | 40/607 |
| 135665 | 12/1902 | Fed. Rep. of Germany | 248/125 |
| 366486 | 2/1932 | United Kingdom | 40/607 |

*Primary Examiner*—John F. Pitrelli

*Attorney, Agent, or Firm*—Brumbaugh, Graves, Donohue & Raymond

[57] ABSTRACT

A free-standing display system comprising a base, an upright post supported from the base and a plurality of shelves mounted on the post, is described. Each of the shelves has an opening dimensioned and shaped to fit freely around the post. The shelves are securely mounted on the post at desired height by means of wedges releasably held on the post by lugs which engage corresponding holes in the post. With the wedges in place, the shelf is moved downwardly around the post until the walls of the shelf opening, which are inclined to match the wedging surface of the wedges, snugly engage the wedging surfaces. Differently shaped and dimensioned shelves may be employed in the system and the shelf opening may be at the shelf centers or adjacent an edge. No tools are required to assemble or disassemble the shelves to the post. A header may be fastened to the upper end of the post, after the desired number of shelves are in place, to carry product identifying indicia or an advertising message.

10 Claims, 7 Drawing Figures

DISPLAY STAND

BACKGROUND OF THE INVENTION

This invention relates to systems and apparatus for displaying goods or articles to prospective purchasers in stores and shops.

In retail stores, such as supermarkets and the like, where articles to be purchased are selected "off the shelf" by the shopper, it is customary to display merchandise on shelves which render it open to view and easily removable. Traditionally, in supermarkets for example, the shelves are arranged in long rows forming aisles through which the shoppers pass. In such arrangements, many different products are displayed in successive sections of the rows of shelves, sometimes making it difficult to locate a specific article that the shopper wishes to purchase. The usual aisle arrangement also limits the effectiveness of so-called "point of purchase" advertising displays, designed to attract shoppers to a particular product.

To overcome these problems, merchants occasionally employ individual shelf displays or islands, free-standing and set off from the aisles formed by the row of shelves, so that they are more visible to the shopper. Such individual units lend themselves to prominent display of a single product and can support point-of-purchase advertising effectively to attract the customer's attention.

Various forms of such free-standing display units are known in the prior art. Some types employ a plurality of vertical standards between which shelves or display racks are suspended; others employ a single post to which shelves or display racks are fastened. The latter type has a particular advantage in that it provides greater visibility for the product displayed, since the display structure itself is less prominent. Heretofore however, such single post shelving units have not become popular because of the complexity required of those known constructions to render them stable and capable of supporting substantial loads, and the attendant high cost.

SUMMARY OF THE INVENTION

The present invention provides a free-standing display system of the single post-type that overcomes the shortcoming of prior art arrangements. The shelves are supported from the post in a manner that not only renders the construction stable and capable of supporting substantial loads but allows ready assembly and disassembly without special tools, providing a practical and versatile system.

The display system according to the invention can be varied as to number and spacing of shelves, as well as the size of the shelves, to suit the requirements of the particular product being displayed. A single post is supported in an upright position from a base member which provides the requisite stability. A plurality of pairs of mounting holes are longitudinally spaced along the post for supporting sets of wedge members where desired, each of the wedge members having a pair of lugs or pins for engaging the mounting holes. The wedge members thus supported from the post provide downwardly diverging outer surfaces around the post which mate with similarly divergent surfaces forming the walls of an opening provided in each of the shelves. The shelves themselves may be formed from structural foam plastic in a single piece, or other materials, sufficiently strong to support substantial loads.

With the wedges in place at any given location along the post, a shelf is then mounted by sliding it down the post, with the post extending through the opening in the shelf, until the inclined walls of the shelf opening meet in wedging engagement with the outer inclined surfaces of the wedges. This maintains the shelf firmly positioned at the desired height and addition of load to the shelf, i.e., the goods to be displayed, serves to increase the wedging action and more rigidly secure the shelf to the post. No tools are required for assembling the shelves to the post.

In a typical system according to the invention, three or more shelves would be secured to the post by means of the wedge arrangement described above. The shelves may be equal in size and shape or of different sizes and the opening in each shelf may be central of the shelf or, for example, near one edge to support the shelf in near cantilever fashion, bearing in mind the need for stability of the final assembly. In assembling such a system, it will be obvious that the lower shelf would be positioned first, the next lower following, and then the uppermost shelf, in that order. Finally, a header unit having surfaces for bearing point-of-purchase advertising messages would be secured to the upper-end of the post as a means of attracting shoppers to its location.

DETAILED DESCRIPTION OF THE PREFERRED EMBODIMENTS

Figure 1:
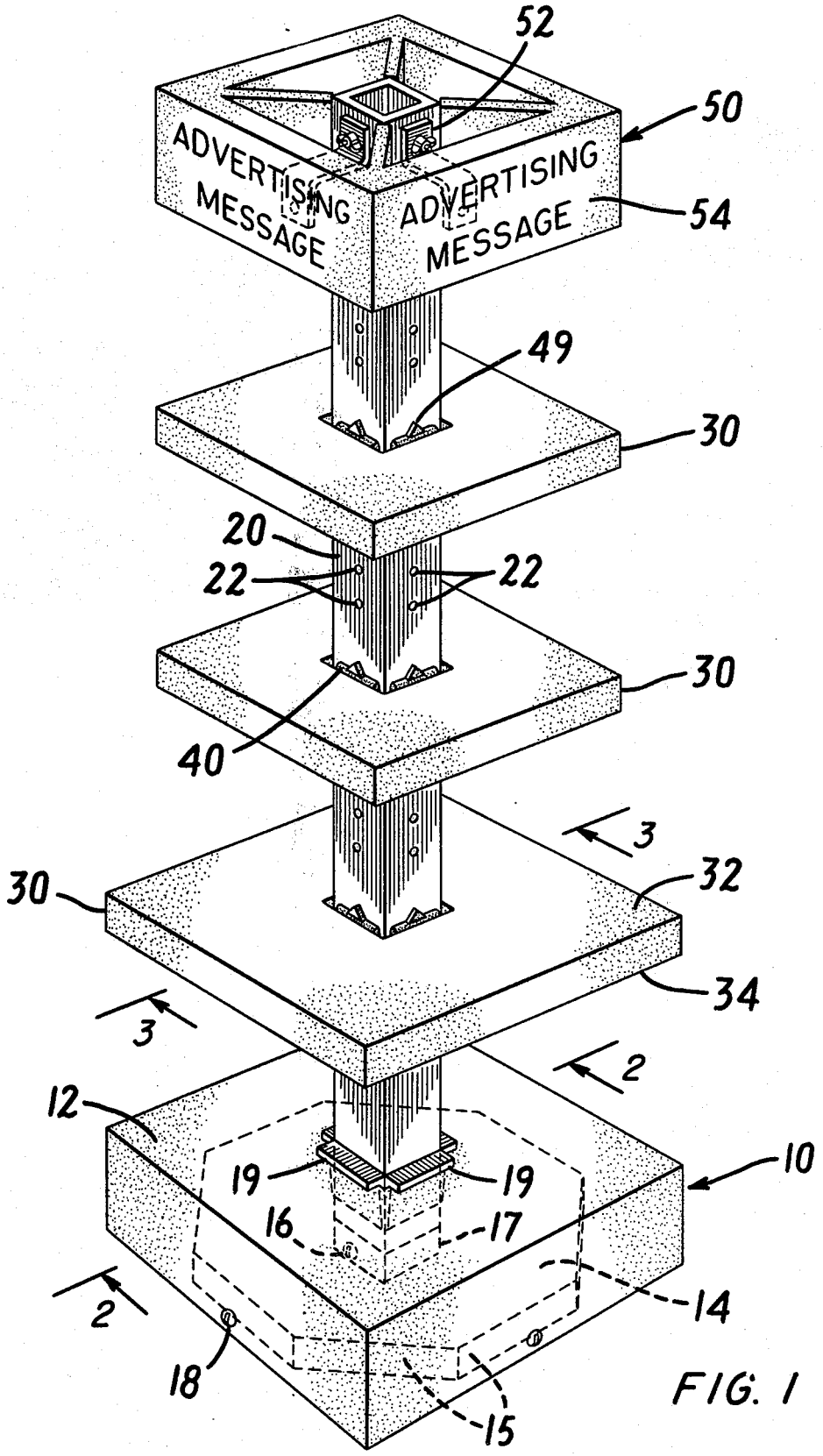
FIG. 1 is a perspective view of the display system of the invention in assembled form.

Referring to the drawings, the display system of the invention is shown in assembled form in FIG. 1. The system includes a base assembly 10 designed to rest on the floor or other flat surface and to support a continuous post 20 of extruded aluminum tubing, for example, in an upright position. A plurality of shelves 30 are mounted on the post at desired spaced locations along its length to carry the articles to be displayed. Finally, a header 50 is secured to the upper end of the post to provide surfaces 54 for carrying eye-catching product identifying indicia or advertising messages that can draw shoppers to the location. In a useful form of the invention, the post is square in cross-section and the base assembly, shelves and header are all square in shape as illustrated in the drawings, but other polygonal or curved configurations are equally feasible.

Figure 2:
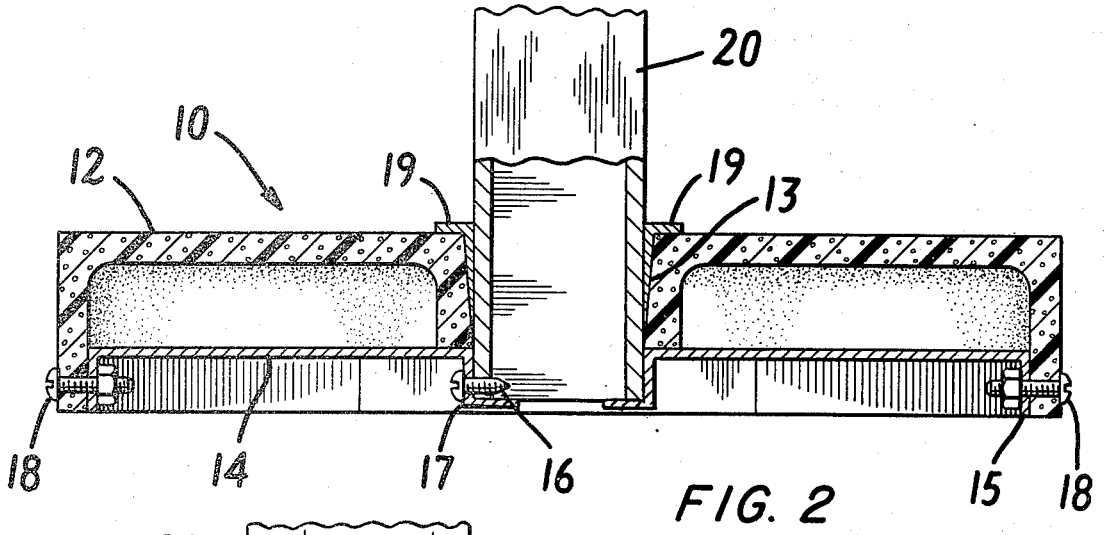
FIG. 2 is a cross-sectional view through the base assembly of the display system of the invention taken along the lines 2—2 of FIG. 1.

Seen more clearly in FIG. 2, the base assembly 10 has a base member 12, which may be formed for example, from structural foam plastic, e.g., polystyrene, which provides an upper flat surface and smooth sidewalls. Preferably, the base member is not solid but formed as a shell of sufficient thickness to give the rigidity required. It, of course, could be made of other materials such as wood or metal.

The base member is provided with an opening 13 for receiving the lower end of the post 20. The opening 13 may be central of the base member, as shown in FIG. 1, or may be offset from the center as will be discussed below. The opening 13 has the same shape as the cross-sectional shape of the post 20 and is defined by walls which are inclined, converging downwardly from the top as shown in FIG. 2. The size of the opening 13 is such as to readily receive the end of the post 20, but with minimum play.

To lend structural rigidity and weight to the base member, a plate or pan 14, preferably of sheet metal, is provided. As shown in FIGS. 1 and 2, the pan 14 includes a relatively flat upper surface with a downturned peripheral flange 15 abutting the four interior surfaces of the base member. A central opening is also provided in the pan 14 with downturned interior flanges 17 to accommodate the post 20 snugly. The flanges 17 include inwardly extending foot portions for engaging the lower end of the post 20. In assembling the base member and post, the post is first inserted through the pan 14 to rest on the foot portions of the flanges 17 and secured on one side by a sheet metal screw 16 or the like. The base member 12 is then slid down the post 20 until its bottom edges meet the pan 14. The base member is secured to the pan by screws and nuts 18 in the four sides. Finally, to take up any clearance between the post and the base assembly, metal wedges 19 are driven in between the post and the base member 12 with a mallet or hammer.

As shown in FIG. 2, the foot portions of the flanges 17 are slightly (e.g., $\frac{1}{8}$ inch) above the lower edges of the member 12 and the peripheral flange 15. When the system is loaded, the pan will flex so that the foot portions rest on the supporting surface, introducing a slight concavity in the pan and increasing its rigidity.

As indicated in FIG. 1, the post is provided with a plurality of pairs of openings or holes 22 in each of its surfaces. These pairs of holes are spaced longitudinally along the post at intervals and, as will be explained hereinafter, enable the shelf positions to be selected to suit the particular needs of the product to be displayed, thereby enhancing the versatility of the system. The holes 22 that are visible in FIG. 1, are those not being used in the shelf arrangement shown. The shelves illustrated conceal from view other sets of holes 22 which have been provided in the post 20.

Figure 3:
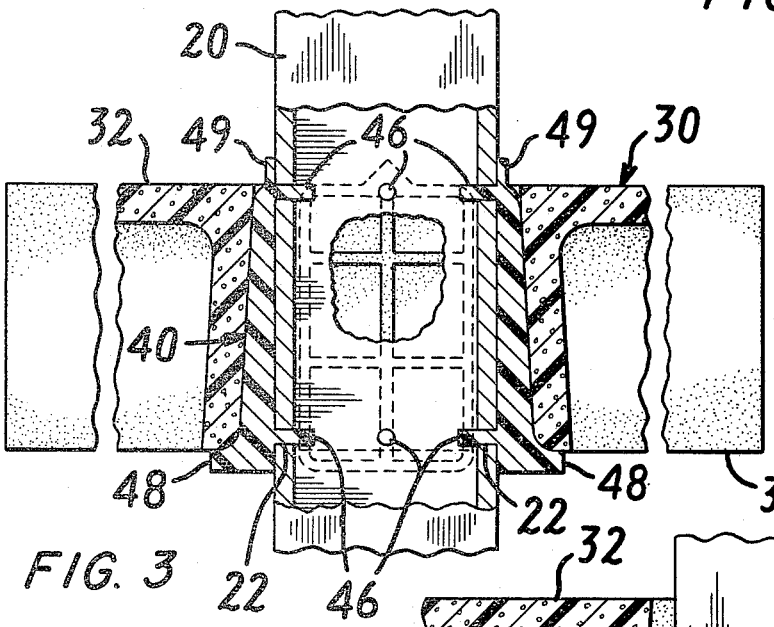
FIG. 3 is a partial cross-sectional view taken along the line 3—3 of FIG. 1, showing the shelf mounting arrangement according to the invention.
Figure 5:
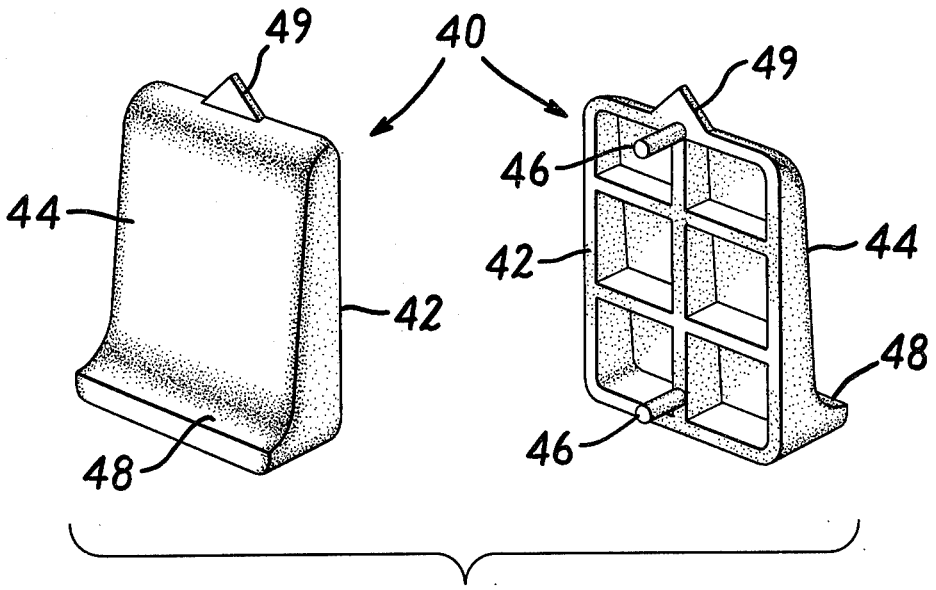
FIG. 5 illustrates, by perspective views of opposite sides, a wedge member in accordance with the invention.
Figure 6:
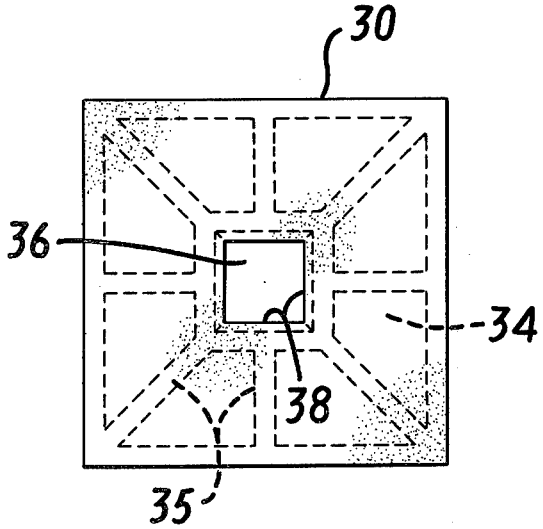
FIG. 6 illustrates a shelf usable in the present invention.

Turning more particularly to FIGS. 3, 5 and 6, the shelf and shelf-mounting arrangement of the present invention are seen in greater detail. Each of the pairs of openings 22, one pair being on each of the four sides of the square cross-section post illustrated, are sized to receive snugly correspondingly spaced lugs or pins 46 extending from one side 42 of a wedge member 40. The wedge member, shown in detail in FIG. 5, is preferably formed of a plastic and has a post engaging side 42 from which the lugs 46 extend perpendicularly, and an outer inclined surface or wedge surface 44 for engaging the shelf. At the lower extremity of the wedge surface 44, a foot portion 48 is provided extending outwardly of the inclined surface 44. The width of the wedge member 40 is selected to be less than the transverse dimension of the post with which it is used and its overall height is just slightly more than the depth of the shelf to be supported thereon. The tabs 49 provide visual indication that wedges are in place in the shelf assembly. As shown in FIG. 5, the wedge member 40 may be integrally molded in shell form to provide the continuous wedge surface 44 and the ribbed post-engaging surface 42, to save materials. It could also be formed from other suitable materials, such as wood or metal, if desired.

Figure 4:
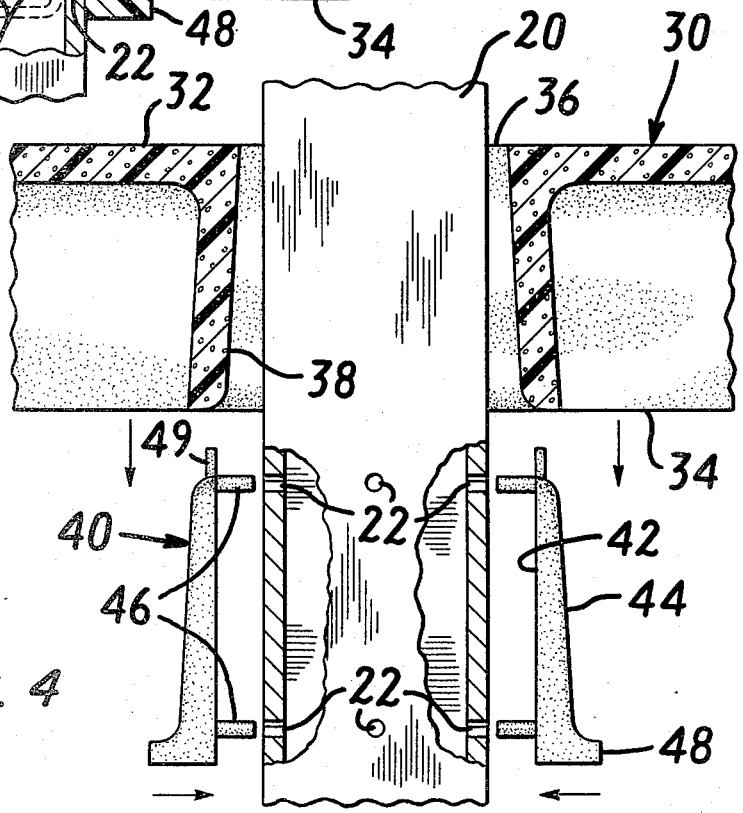
FIG. 4 is an exploded view in partial section illustrating the manner of mounting the shelves of the display system of the invention on the post.

With the post 20 in its upright position, on the base assembly 10, the manner in which the shelves 30 are mounted to the post is shown in FIG. 4. The first step is to mount four wedge members 40 on respective sides of the post 20 by inserting the wedge lugs into the corresponding openings 22. In FIG. 4 only two such wedges are shown but it will be understood that additional wedges will be on the front and rear surfaces of the post. With the wedges in place, as shown in FIG. 3, the shelf 30 is then ready to be put in place.

Shelf 30 may be rectangular as shown, although other shapes may be selected, and is formed preferably of a structural foam plastic. Typically, such shelves are molded as a shell with a smooth flat upper surface 32 and a lower surface 34 provided with ribs such as indicated at 35 in FIG. 6. These ribs lend structural strength to the shelf and may be arranged in various patterns to suit the load bearing requirements. The shelf is also provided with an opening 36 extending through the shelf which is shaped and dimensioned to fit freely around the post 20. The walls 38 defining the shelf opening are inclined, diverging outwardly from top to bottom at the same angle as the wedge angle of the surface 44 of the wedge member 40 (FIGS. 3 and 4). As seen in FIG. 4, the minimum dimensions of the opening 36 in the shelf provide clearance between the shelf and the post for accommodating the wedge thickness in all sides.

To assemble the shelf to the post with the wedges inserted, the shelf is lowered along the post 20, with the post extending through the opening 36, until the surfaces 38 contact the wedge members 40 on the post. The angles and dimensions of the shelves and the mating wedges are chosen such that a snug wedge fit is achieved between the interior walls 38 of the shelf opening 36 and the outer surfaces of the wedge members 40. Ordinarily, such wedging fit would be sufficient to support the shelf firmly on the post and prevent it from dropping under load. However, as a safety factor in the event of deformation of the plastic or manufacturing errors, a foot portion 48 is provided at the bottom of the inclined outer surface of the wedge members to provide an added stop or detent to limit downward movement of the shelf. When in place, the shelf conceals the wedge members from view except for the tabs 49, which show that the wedge members are properly in place.

In assembling an overall display system such as shown in FIG. 1, it will be obvious that the lowermost shelf is first secured to the post in the manner described above and then the succeeding shelves similarly secured in ascending order. Finally, the header 50 may be secured to the top of the post by means of fastening brackets 52 screwed into the post.

It will be realized from the above that the shelves may be mounted on the post entirely without tools and the only tools necessary to mount the base member and header are a screw driver and a hammer or mallet. Thus the system lends itself to ready erection in a market by salesman or market personnel and likewise, to ready disassembly and movement or removal from the market. By affording a choice of shelf locations on the post, a single system may be adapted to display products of varying sizes and configurations. Although shelves of two different sizes are shown in the assembly of FIG. 1, it will be apparent that all of the shelves may be of the same size or all may be of different sizes depending on the desires of the market manager or salesman, as long as gross unbalances are avoided. Since in the arrangement of FIG. 1, equal capacity and access on all four sides of the shelves is available, this configuration is specially suited to an "island" application.

Figure 7:
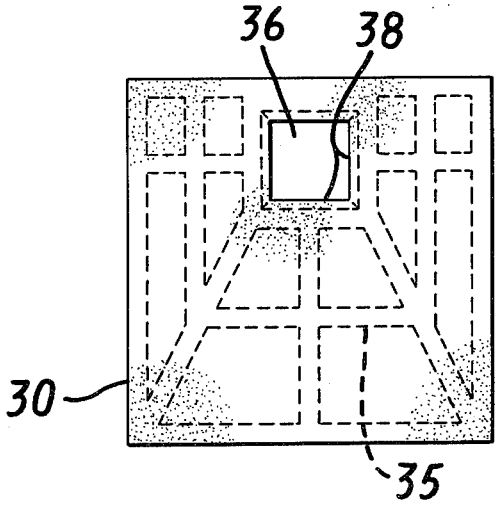
FIG. 7 illustrates an alternative form of shelf usable with the present invention.

A variation of the system shown in FIG. 1, particularly adapted for placing against a wall, is available simply by employing shelves such as shown in FIG. 7, with a similarly configured base member. Specifically, in the shelf of FIG. 7, the opening 36 is provided near one edge of the shelf so that when supported on the post in the manner described in connection with FIGS. 3 and 4, the shelf is cantilevered on three sides of the post. The other side is then placed against the wall and maximum shelf area is available for the product to be displayed.

As can be appreciated, virtually unlimited variations of shelf size combinations, spacings, shapes etc., are available with the present invention. Although in the preferred embodiment the post 20 is square in cross section and formed of an extruded aluminum tubing, for lightness, the post may be of various polygonal or curved cross sectional shapes, the wedge members 40 and the openings 36 in the shelves being appropriately shaped to conform. Likewise, the shelves 30 may have peripheries of various configurations as desired.

Many different variations of the inventive concepts illustrated in the preferred embodiments will occur to those skilled in the art and it is to be understood that the invention is limited only as set forth in the appended claims.

We claim:

1. An article display system comprising a post having a plurality of openings therein angularly spaced around the periphery of said post at a predetermined position along its length, means for supporting said post in an upright position, a shelf having an article supporting surface and an opening therethrough dimensioned and shaped to fit freely around said post, wedge means for mounting said shelf on said post, said wedge means including a plurality of wedge members each having a lug extending from one surface thereof, said lug adapted to be inserted into one of said openings in said post to releasably secure said wedge members to said post, said wedge means adapted to snugly engage said shelf within said opening to support said shelf firmly on said post.

2. The article display system of claim 1 further including header means adapted to be secured to the upper end of said post and including surfaces adapted to carry advertising messages.

3. An article display system comprising:

a post having a plurality of openings therein, a base for supporting said post in an upright position, at least one shelf having an article supporting surface and an opening therethrough dimensioned and shaped to fit freely around said post, and wedge means for mounting said shelf on said post, said wedge means including a plurality of like wedge members, each of said wedge members having a post-engaging side and an inclined surface opposite said post-engaging side, and at least one lug extending from said post-engaging side adapted to be received in one of said openings in said post, said wedge members thereby being adapted to be individually releasably secured to said post at a predetermined position along its length and at angularly spaced locations around the periphery thereof, said wedge means being adapted to snugly engage said shelf within said opening to support said shelf firmly on said post at said predetermined position.

4. The article display system of claim 3 wherein the inclined surface of each of said wedge members diverges outwardly from top to bottom and the opening in each said shelf is defined by downwardly diverging walls for engaging each of the inclined surfaces of said wedge members, whereby with said wedge members secured to the post and the upper end of the post extending through the opening in the shelf, the shelf may be moved downwardly along the post to bring the diverging walls of said opening into engagement with the inclined surfaces of said wedge members, thereby to secure said shelf at said predetermined position.

5. The article display system of claim 4 wherein openings for receiving the lugs on said wedge members are provided at spaced intervals along the length of said post whereby one or more of said shelves may be mounted at different desired heights on said post.

6. The article display system of claim 5 wherein said post is polygonal in cross-section and the opening in said shelf is correspondingly polygonal in shape, the openings in said post for receiving the lugs of said wedge members being disposed in a plurality of the flat surfaces of said post at each shelf supporting position.

7. The article display system of claim 6 wherein said post cross-section and said shelf opening are square in shape and a wedge member is adapted to be secured to each of the four sides of said post for supporting each shelf.

8. The article display system of claim 4 wherein each of said wedge members includes an elongated foot portion extending outwardly of said inclined surface along the bottom edge thereof.

9. The article display system of claim 8 wherein each of said wedge members include a pair of lugs extending perpendicularly from the post-engaging side thereof and said lugs and said foot portion are integrally formed with said wedge member.

10. An article display system comprising:

a post, a base for supporting said post in an upright position, said base including a base member having integral upper surface and side walls depending from said upper surface, said upper surface having an opening therein to receive the lower end of said post, a base plate having a flat upper surface, a peripheral flange, an opening to receive the lower end of said post, and a flange extending at least partway around said plate opening, said base plate being sized so that said peripheral flange contacts snugly the interior surfaces of the depending side walls of said base member, means for releasably fastening said peripheral flange to the side walls of said base member and said plate opening flange to said post, and wedge means adapted to be inserted between said post and base member, at least one shelf having an article supporting surface and an opening therethrough dimensioned and shaped to fit freely around said post, and wedge means for mounting said shelf on said post, said wedge means adapted to be releasably secured to said post at a predetermined position along its length and to snugly engage said shelf within said opening to support said shelf firmly on said post at said predetermined position.

* * * * *